US005079818A

United States Patent [19]

Schwab

[11] Patent Number: 5,079,818

[45] Date of Patent: Jan. 14, 1992

[54] RIVETING APPARATUS

[75] Inventor: Manfred Schwab, Taunusstein, Fed. Rep. of Germany

[73] Assignee: Maschinenbau Subotsch und Schwab GmbH, Taunusstein, Fed. Rep. of Germany

[21] Appl. No.: 653,002

[22] Filed: Feb. 8, 1991

[30] Foreign Application Priority Data

Feb. 10, 1990 [DE] Fed. Rep. of Germany ... 9001315[U]

[51] Int. Cl.[5] ..... B21L 15/04

[52] U.S. Cl. ..... 29/243.527; 29/243.526; 72/391.8; 72/114

[58] Field of Search ..... 29/243.527, 243.526, 29/243.521; 72/391.2, 391.4, 114, 391.8

[56] References Cited

U.S. PATENT DOCUMENTS

| | | | |
|---|---|---|---|
| 3,933,019 | 1/1976 | Underland et al. | 72/114 |
| 4,118,966 | 10/1978 | Jackson | 72/114 |
| 4,140,000 | 2/1979 | Ehmann | 72/114 |
| 4,649,732 | 3/1987 | Molina | 72/114 |

FOREIGN PATENT DOCUMENTS

| | | | |
|---|---|---|---|
| 1394760 | 5/1975 | United Kingdom | 72/114 |
| 2122716 | 1/1984 | United Kingdom | 29/243.527 |
| 2172233 | 9/1986 | United Kingdom | 72/114 |

*Primary Examiner*—David Jones
*Attorney, Agent, or Firm*—Barnes, Kisselle, Raisch, Choate, Whittemore & Hulbert

[57] ABSTRACT

In a hand-held riveting apparatus having two pivotal levers for performing the actual riveting operation and a screwthreaded mandrel which can be caused to rotate for screwing on the rivet nut and for screwing out the rivet nut after the rivet setting operation. Provided at the rear end of the apparatus housing which is in opposite relationship to the screwthreaded mandrel is a turning mechanism in the form of a rotary head which is non-rotatably connected to a draw spindle which inturn is connected to the screwthreaded mandrel which projects at the front end of the apparatus.

7 Claims, 2 Drawing Sheets

RIVETING APPARATUS

The invention relates to a riveting apparatus having two pivotal levers for performing the actual riveting operation and a screwthreaded mandrel which can be caused to rotate for screwing on the rivet nut and for screwing out after the rivet setting operation.

A riveting operation can admittedly be carried out without difficulties, with apparatuses of that kind, but it requires a large number of handling operations which represent stress for the operator, which in the course of prolonged operating periods results in fatigue phenomena, while in addition the performance of the individual handling operations requires a great amount of time. Thus, firstly the lever arms have to be completely opened and the screwthreaded mandrel has to be set rotating. For that purpose it is known for a hand knob on a draw tube mounted on the screwthreaded mandrel to be pushed back while the riveting nut is screwed on to the screwthreaded mandrel, between the thumb and the index finger, on the housing of the apparatus. The actual riveting operation is performed by the two lever arms being pressed together inwardly. Thereupon, by actuation of the draw tube, the screwthreaded mandrel is screwed out of the rivet nut. In order to make it easier to carry out the riveting operation, it is already known to provide at the end of the screwthreaded mandrel an electric motor which can cause the screwthreaded mandrel to rotate. The electric motor with the battery required for that purpose however means that the apparatus is then of comparatively high weight so that moving around with the apparatus is made more difficult as a result and the operator has to apply a comparatively large amount of force.

The invention is therefore based on the problem of providing a riveting apparatus which permits advantageous operation for carrying out the riveting operation, in which fatigue phenomena on the part of the operator and the processing time are reduced.

The invention provides that disposed at the rear end of the housing of the apparatus, which is in opposite relationship to the screwthreaded mandrel, is a turning means in the form of a rotary head which is non-rotatably connected to a draw spindle connected to the screwthreaded mandrel which projects at the front end of the apparatus housing.

In order to reduce the force applied, the invention further proposes that the rotary head is disposed in a cylinder-like configuration around the rear end of the housing apparatus and is connected to an entrainment means which drives a transmission means arranged at the rear end of the draw spindle.

Rotary markings are advantageously provided on the apparatus housing.

For the purposes of improved operation, it may be provided that the rotary head is arranged laterally on the apparatus housing outside the plane of the handle tubes and is connected by way of a gear transmission means to the draw spindle. In that arrangement it is advantageously provided that the rotary shaft of the rotary head extends in a plane perpendicularly to the draw spindle and that the rotary shaft carries a bevel gear meshing with a bevel gear carried on the draw spindle.

In accordance with an advantageous embodiment the rotary head is mounted on a sleeve which is carried rotatably on the rear end of the apparatus housing, wherein the sleeve can be fixed in different positions in dependence on the mode of operation of the apparatus.

For that purpose the sleeve advantageously carries a fixing pin which engages into openings provided on the apparatus housing. It may also advantageously be provided that the sleeve is steplessly adjustable in respect of its rotary position by a frictional fit on the apparatus housing.

This apparatus can be adapted to the mode of operation by the operator, is comparatively light and permits greater ease of operation. The apparatus is of comparatively low weight and is shorter than known apparatuses, so that it can be handled better, and it is distinguished by being of a compact structure. It requires a comparatively small amount of force to be applied.

The invention will be described in greater detail hereinafter by means of an embodiment with reference to the accompanying drawings in which.

Figure 1:
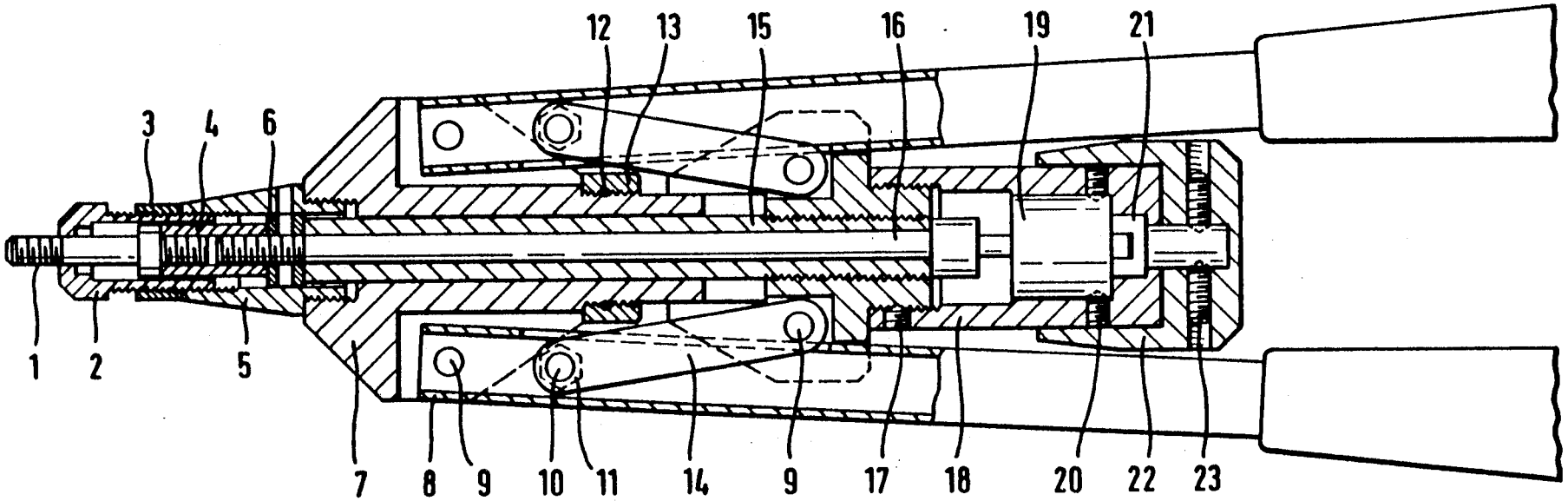
FIG. 1 is a view in section of a riveting apparatus for blind rivet nuts.

In the hand riveting apparatus shown in FIG. 1 for blind rivet nuts, the screwthreaded mandrel 1 projects out of the mouthpiece 2 which is fixed by means of a lock nut 3. The screwthreaded mandrel receiving means 4 is disposed in the front sleeve portion 5 in which the mouthpiece 2 is also fixed. Fixing is effected by a rear lock nut 6. The handle or gripping tubes 8 of the levers are secured by pins 9 to the front apparatus housing 7. The front end of the tongs legs 14 is pivotally connected by means of a screwthreaded pin 10 and a securing nut 11, while the rearward end thereof is fixed to the apparatus with pins 9. A stroke setting screw 13 with O-ring 12 is mounted to the front housing 7. The draw spindle 16 extends through the rear housing 15. A guide sleeve 18 is mounted to the rear housing 15 by means of screwthreaded pins 17. A planetary transmission 19 is carried in the guide sleeve 18 and fixed by the screwthreaded pins 20. Extending from the planetary transmission 19 is an entrainment member 21 to which a rotary head 22 is fixed by screwthreaded pins 23.

When the rotary head 22 is turned, the planetary transmission 19 is actuated by way of the entrainment member 21 and in turn causes the spindle 16 to rotate. In that way it is possible, by rotation of the rotary head 22, to screw the screwthreaded mandrel on to the blind rivet nut and to screw it out again after the rivet setting operation.

Figure 2:
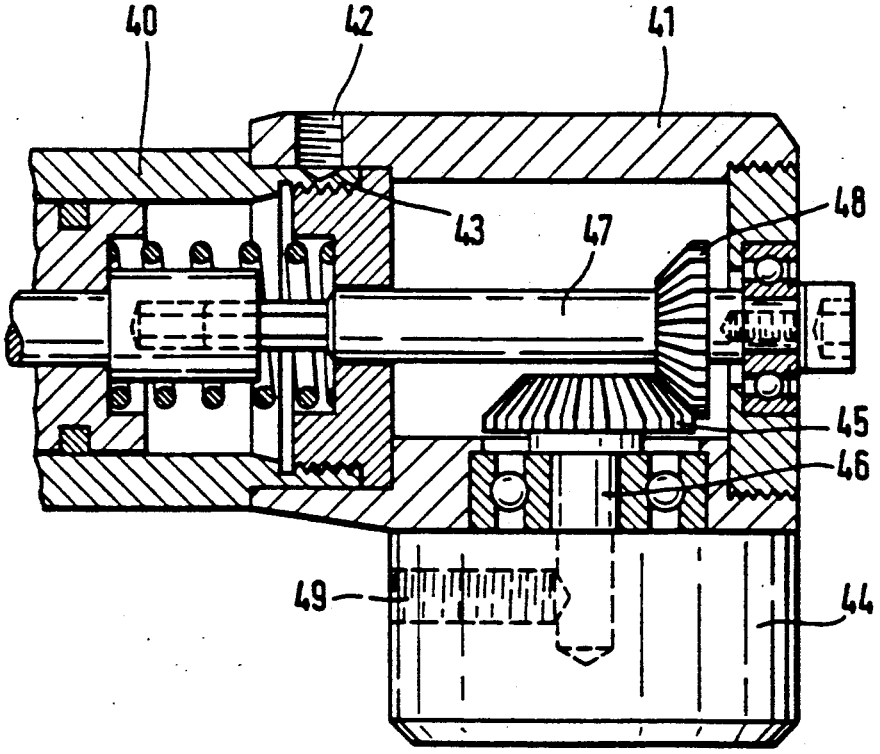
FIG. 2 is a modified view of the turning means in section for an apparatus as shown in FIG. 1.

FIG. 2 shows a modified embodiment. Carried on the apparatus housing 14 is a sleeve 41 which is arranged to be rotatable in relation to the apparatus housing. Provided in the sleeve 41 is a bore 42 through which a fixing pin (not shown) engages into an opening 43 provided in the apparatus housing 40. In that way, by virtue of a multiplicity of openings 43 which are distributed around the periphery of the assembly, the sleeve 41 can be fixed in different positions in relation to the apparatus housing 40. It is also possible however to provide a frictional fit so that the sleeve 41 is steplessly adjustable in relation to the apparatus housing 40. Therefore, by means of the sleeve 41, a rotary head which is disposed laterally thereon can be moved into a position relative to the apparatus housing 40, as circumstances require in the assembly operation or as is most acceptable to the operator. Connected to the rotary head 44 is a bevel gear 45, the shaft 46 of which extends perpendicularly to the draw spindle 16.

The draw spindle 16 is connected to an extension spindle 47 carrying a bevel gear 48 meshing with the bevel gear 45 of the shaft 46 to which the rotary head 44 is connected. The rotary head is non-rotatably connected to the shaft 46 by means of a pin or bolt (not shown) which is carried in a bore 49 in the rotary head. In that way, by means of the laterally disposed rotary head 44 and by way of the draw spindle 16, the mandrel 1 can be rotated in order to screw on the screwthreaded rivet nut and to screw out the screwthreaded mandrel 1 after the riveting operation. The invention thus provides an apparatus for setting screwthreaded rivet nuts wherein rotary movement of the screwthreaded mandrel is effected in a simple manner by means of the screwthreaded head 22, 44 and the head 44 can be moved into an optimum position. The apparatus can be operated by hand or hydraulically.

I claim:

1. A hand-held riveting apparatus comprising a housing, two pivotal levers connected to said housing and operationally connected to the apparatus for performing the actual riveting operation, a screw threaded mandrel projecting at a front end of said housing and which can be caused to rotate for screwing on the rivet and for screwing out the rivet after the rivet setting operation, a draw spindle connected to a rear end of said screw threaded mandrel and extending through a rear end of said housing, an extension spindle connected to said draw spindle and bearing a first gear transmission means, a sleeve mounted on said rear end of said housing and surrounding said extension spindle, and a turning means in the form of a rotary head arranged laterally on said sleeve and extending outside the plane of said two pivotal levers and perpendicularly to said extension spindle, said rotary head carrying a second gear transmission means which meshes with said first gear transmission means carried on said extension spindle, wherein said rotary head when rotated causes said screw threaded mandrel to be selectively rotated in a manner to screw on or screw out the rivet.

2. Apparatus according to claim 1 wherein each of said gear transmission means comprises a bevel gear.

3. Apparatus according to claim 1 wherein said rotary head is of a cylinder form.

4. Apparatus according to claim 1 wherein said rotary head is mounted on said sleeve carried rotatably on the rear end of said apparatus housing.

5. Apparatus according to claim 4 characterized in that said sleeve can be fixed in different positions.

6. Apparatus according to claim 5 characterized in that the sleeve carries a fixing pin which engages into openings provided on the apparatus housing.

7. Apparatus according to claim 6 characterized in that the sleeve is steplessly adjustable in respect to its rotational position by a friction fit on the apparatus housing.

* * * * *